US011187227B2

(12) United States Patent
Rossi

(10) Patent No.: US 11,187,227 B2
(45) Date of Patent: Nov. 30, 2021

(54) BI-HELICAL TOOTHED WHEEL WITH VARIABLE HELIX ANGLE AND NON-ENCAPSULATED PROFILE FOR A HYDRAULIC GEAR APPARATUS

(71) Applicant: Settima Meccanica S.r.l., San Giorgio Piacentino (IT)

(72) Inventor: Manuele Rossi, Ponte dell'Olio (IT)

(73) Assignee: SETTIMA MECCANICA S.R.L., San Giorgio Piacentino (IT)

( * ) Notice: Subject to any disclaimer, the term of this patent is extended or adjusted under 35 U.S.C. 154(b) by 535 days.

(21) Appl. No.: 15/651,538

(22) Filed: Jul. 17, 2017

(65) Prior Publication Data

US 2018/0023561 A1 Jan. 25, 2018

(30) Foreign Application Priority Data

Jul. 20, 2016 (IT) ..... 102016000076227

(51) Int. Cl.
*F04C 2/107* (2006.01)
*F01C 1/18* (2006.01)
(Continued)

(52) U.S. Cl.
CPC ..... *F04C 2/107* (2013.01); *F01C 1/18* (2013.01); *F04C 2/084* (2013.01); *F04C 2/18* (2013.01); *F01C 1/084* (2013.01)

(58) Field of Classification Search
CPC .. F01C 1/084; F01C 1/18; F01C 1/107; F01C 21/003; F04C 2/084; F04C 2/107;
(Continued)

(56) References Cited

U.S. PATENT DOCUMENTS 2,098,864 A * 11/1937 Forster ..... F16H 55/08 74/466
5,472,383 A * 12/1995 McKibbin ..... F16H 57/0482 184/6.12

(Continued)

FOREIGN PATENT DOCUMENTS

DE 10148476 A1 4/2003
DE 202014007647 U1 1/2015

(Continued)

OTHER PUBLICATIONS

Italian Patent Office, "Search Report" in application No. 201600076227, dated Feb. 14, 2017, 2 pages.

*Primary Examiner* — Mary Davis
*Assistant Examiner* — Paul W Thiede
(74) *Attorney, Agent, or Firm* — Hickman Becker Bingham Ledesma LLP; Malgorzata A. Kulczycka

(57) ABSTRACT

The invention relates to a bi-helical toothed wheel (1) with non-encapsulating profile for a hydraulic gear apparatus, of the type bound to a support shaft (5) to form a driving or driven wheel of the hydraulic apparatus and comprising a plurality of teeth (6) extended with variable helix angle with continuous function in the longitudinal direction, wherein the teeth profile keeps a shape continuity in each cross section thereof. More particularly, each tooth of the toothed wheel is longitudinally split in three zones: initial (A), central (B) and terminal (C) zones, and the central zone (B) has a variable helix angle, while the initial (A) and terminal (c) zones have a constant helix angle. The invention allows to manufacture contra-rotating rotors, having a non-encapsulating profile and a helix shape such as to suppress the angular point at the center of the rotors themselves and therefore all the problems related to their machining.

11 Claims, 10 Drawing Sheets

(51) Int. Cl.
*F04C 2/18* (2006.01)
*F04C 2/08* (2006.01)
*F01C 1/08* (2006.01)

(58) Field of Classification Search
CPC .... F04C 2/18; F04C 15/0023; F04C 15/0026; F04C 15/0042; F04C 18/16; F04C 18/18; F04C 2240/50; F04C 2240/56; F04C 29/0021; F04C 2/16; F04C 18/086; F04C 23/001; F04C 1/18; F04C 1/084; F02C 2/086
USPC ..... 418/201.1, 9, 132, 203, 206.1–206.9
See application file for complete search history.

(56) References Cited

U.S. PATENT DOCUMENTS 7,040,870 B2 * 5/2006 Nicolas ..... F04C 2/086 417/53
9,567,999 B2 * 2/2017 Ferretti ..... F04C 2/18
2005/0129561 A1 * 6/2005 Heizer ..... F01C 1/084 418/201.1
2011/0223051 A1 * 9/2011 Giuseppe ..... F04C 2/084 418/206.5
2012/0012400 A1 * 1/2012 Saccani ..... E02D 3/12 175/424
2016/0265528 A1 * 9/2016 Ferretti ..... F04C 15/0042
2016/0349163 A1 * 12/2016 Chen ..... G01N 11/14
2017/0298733 A1 * 10/2017 Williams ..... B29D 15/00

FOREIGN PATENT DOCUMENTS

EP 1550542 A1 7/2005
GB 263540 A 12/1926
WO WO-2014191253 A1 * 12/2014 ..... F01C 1/084

* cited by examiner

BI-HELICAL TOOTHED WHEEL WITH VARIABLE HELIX ANGLE AND NON-ENCAPSULATED PROFILE FOR A HYDRAULIC GEAR APPARATUS

PRIORITY CLAIM

This application claims the benefit of and priority to Italy patent application 102016000076227, filed Jul. 20, 2016, the entire contents of which is hereby incorporated by reference as if fully set forth herein.

APPLICATION FIELD

The present invention relates to a bi-helical toothed wheel with non-encapsulating profile, adapted to be engaged in a hydraulic gear apparatus.

More particularly, the invention relates to a toothed wheel intended to be engaged without encapsulation with a toothed wheel of the same type in a hydraulic gear apparatus.

Typical examples of hydraulic gear apparatuses, where the toothed wheels of the present invention are optimally applied and to which specific reference will be made below in the present description, are rotary volumetric gear pumps. However, the toothed wheels of the present invention may also be applied to hydraulic gear motors and/or to all hydraulic apparatuses operating through a pair of gears, which are thus included in the scope of the present invention.

PRIOR ART

As is well known in this technical field, rotary volumetric gear pumps generally comprise two toothed wheels, in most cases of the straight teeth type, one of which (referred to as a driving wheel) being connected to a control shaft and actuating the other wheel (referred to as a driven wheel).

In the toothed wheels with straight teeth, each pair of teeth simultaneously meshes over the whole axial width of the toothed portion and similarly unmeshes. This type of coupling mechanically causes vibrations and noises due to load variation on the tooth and to access and return shocks.

Another disadvantage which is particularly felt in the aforesaid gear pumps of traditional type is that the pumped fluid is encapsulated, i.e. entrapped and compressed, or in any case subjected to volume variations in the spaces enclosed between the teeth profiles in the engagement zone, thus leading to detrimental and uncontrolled local stress peaks which cause a direct hydraulic operation noise.

A known technical solution to obviate the direct hydraulic operation noise consists in adopting toothed wheels having helical teeth. The teeth of these toothed wheels are oriented according to cylindrical helices, instead of being parallel to the wheel axis.

In the toothed wheels with helical teeth, due to the slope, each pair of teeth gradually meshes and unmeshes, thus leading to a more noiseless and regular transmission.

Although these toothed wheels are advantageous in many respects and substantially responsive to the purpose of reducing the operation noise, they introduce other problems due to their particular structure. Indeed, due to the teeth slope, the transmitted force splits into a tangential component, needed to transmit the torsional moment, and an axial component, tending instead to displace the wheel.

In order to obviate this problem, either thrust bearings or two opposite helices having complementary angles are used, thus suppressing the axial thrust generated.

The invention aims at obviating the utilization of thrust bearings or of any other type of contrivance for compensating for the axial forces internally generated, and focuses instead on opposite helices.

Accompanying FIG. 1 shows a known example of toothed wheel with opposite helices, normally referred to as having herringbone gears.

The herringbone gears in FIG. 1 are used as rotors for hydraulic pumps in low speed and high power applications.

Although this type of toothing has been in use for many years, the profile accuracy of the teeth and the hardness thereof are limited by the construction difficulties due to machining at the cusp.

Indeed, the machines used to manufacture this type of toothed wheels are slotting machines in which the two opposite helices are simultaneously machined with a reciprocating motion of blades which mutually interfere at the cusp.

This process is limited by the impossibility of achieving large wheels with high hardness, since the machining at the cusp point is so delicate and difficult that gears made of materials having a hardness higher than 35 Rockwell C cannot be obtained.

These gears may be treated with thermal nitridation treatments following the tooth machining, for example. However, the tooth twisting upon the heat treatment forces the designer to use wider tolerances in order to prevent damages to the tooth surface, thus obtaining lower efficiencies.

An alternative solution is shown in FIG. 2, where an interspace is provided between the two helices, which allows to use a variety of machine tools for manufacturing the gear and achieving optimal accuracies even on high hardnesses, e.g. higher that 58-60 Rockwell C. However, these gears may not be used for pumping applications.

For example, in U.S. Pat. No. 6,912,786, which relates to a gear with involute profile, in particular with herringbone toothing, and to a process for manufacturing such a gear, these problems were solved, i.e. a tooth hardness of about 58-60 HRC and dimensional tolerance improvement, but without solving the problems of fluid encapsulation between tooth crest and bottom, which is typical of involute gears. Moreover, the outlets in the middle of the rotor inevitably create a volume efficiency loss of the pump.

In addition, the pump is specifically adapted to pump molten plastic material.

U.S. Pat. No. 7,040,870 B1 also falls within the field of external gear pumps for feeding elastomeric material. The gear has a curved central segment equal to p/2, where p corresponds to the transverse pitch.

The curved segment is specifically used to improve some issues related to the thermoplastic material pumping with respect to a traditional herringbone gear.

Moreover, the tooth profile is of the involute type, the same as that of the transverse sections of standard cylindrical gears used for gear pumps, thus not solving the problems of fluid encapsulation between tooth crest and bottom.

The technical problem underlying the present invention is to devise a new type of bi-helical toothed wheel for hydraulic gear apparatuses, which has structural and functional features such as to simultaneously allow to cancel the mechanical and hydraulic operation noise and avoid the generation of axial thrusts which require possible force compensation.

It is another object of the present invention to provide a bi-helical toothed wheel which is simple and easy to be manufactured by means of numerically controlled machines of the substantially conventional type.

It is a further object of the present invention to manufacture a gear for volumetric pumps and other types of hydraulic apparatuses which is completely free from encapsulation.

SUMMARY OF THE INVENTION

The solution idea underlying the present invention is to obtain a bi-helical toothed wheel with variable helix angle along the axial direction of the tooth, with non-encapsulating tooth profile, while keeping a shape continuity of the cross section thereof.

In other words, the tooth starts in axial or longitudinal direction as a helical tooth with a certain helix angle, e.g. right-handed, and ends again as a helical tooth but with left-handed helix angle, ensuring that the angle continuously varies during the path, avoiding the presence of angular points, and with symmetry with respect to the half-length of the tooth, thus achieving a desired axial balance.

In a preferred embodiment, the helix angle of the tooth varies over the whole length of the gear to substantially form a parabolic arc.

Based on the above-mentioned solution idea, the technical problem is solved by a bi-helical toothed wheel for hydraulic gear apparatuses, of the type bound to a support shaft to form a driving or driven wheel of said hydraulic apparatus and comprising a plurality of teeth helically extended in longitudinal direction, characterized in that the helix development is continuously curved along the longitudinal direction of the tooth while keeping a shape continuity of the cross section thereof.

Each tooth of the toothed wheel of the invention is advantageously split in three zones: the initial, central and terminal zones, where the central zone has a variable helix angle, whereas the initial and terminal zones have a constant helix angle.

Moreover, said central zone is free from cusps.

The shape continuity of the cross section thereof further coincides with the front profile of the toothed wheel.

Alternatively, the helical development of the central zone of the tooth is an arc of circle.

In essence, the profile has a central connection point with a zero derivative.

This central zone of the helical tooth development is obtained with variable pitch and helix angle.

On the other hand, the initial and terminal zones have constant pitch and helix angle.

The invention is applied to a hydraulic gear apparatus comprising a pair of engaging toothed wheels without encapsulation. Such an apparatus may be a volumetric pump, for example.

The features and advantages of the bi-helical toothed wheel obtained according to the invention for hydraulic gear apparatuses will become apparent from the following description of an embodiment thereof given by way of non-limiting example with reference to the accompanying drawings.

DETAILED DESCRIPTION

With reference to these figures, numeral 1 diagrammatically indicates as a whole a toothed wheel of the bi-helical profile type manufactured in accordance with the present invention.

In particular, but not exclusively, the toothed wheel is designed for hydraulic gear apparatuses, and the following description will refer to this specific application field in order to simplify the exposition thereof.

In order to better understand all the aspects of the present invention, it is worth noting that the term "cylindrical helix" refers to a curve described by an animated point of continuous circular motion, and at the same time, of uniform straight motion with direction perpendicular to the rotation plane.

Moreover, the term "helix pitch" will define below the distance traveled by the helix generator point over a complete turn in axial direction.

The invention aims at providing a bi-helical toothed wheel which can be used with a wheel of the same type in a gear for a volumetric pump using contra-rotating rotors. According to the invention, wheel 1 advantageously has a non-encapsulating profile and a helix shape so as to suppress the angular point in the middle of the traditional herringbone gears manufactured according to the prior art.

Thereby, the cause of those problems related to the machining of rotors having such a profile is suppressed.

Figure 1:
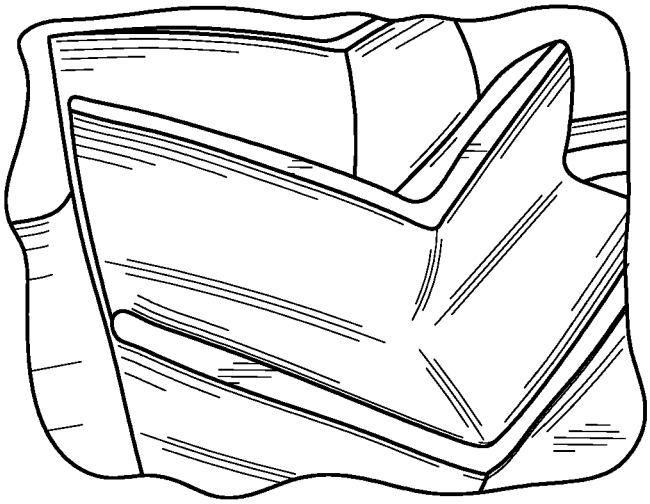
FIG. 1 PRIOR ART
FIG. 1 shows a diagrammatic perspective view of a herringbone toothed wheel according to the prior art.
Figure 2:
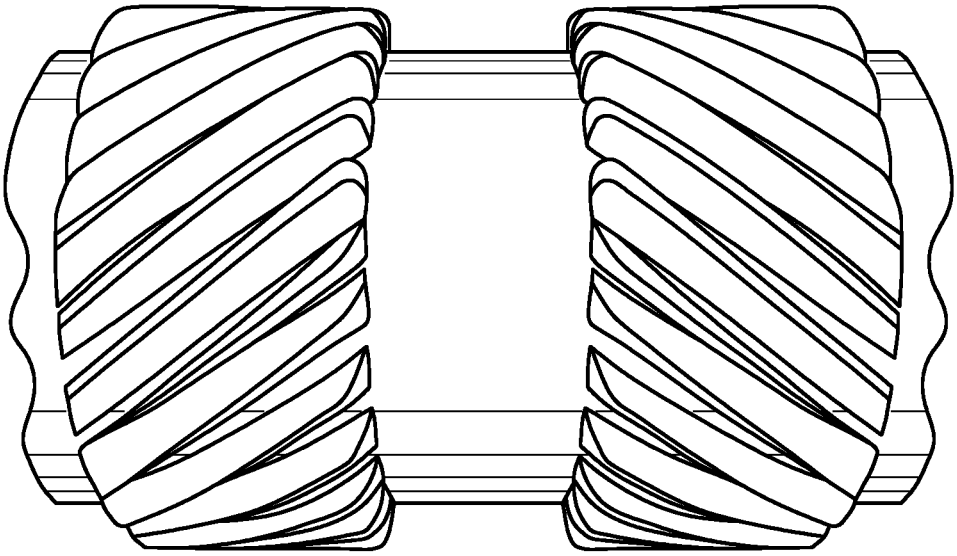
FIG. 2 PRIOR ART
FIG. 2 shows a diagrammatic perspective view of a bi-helical toothed wheel with separated helices according to the prior art.
Figure 3:
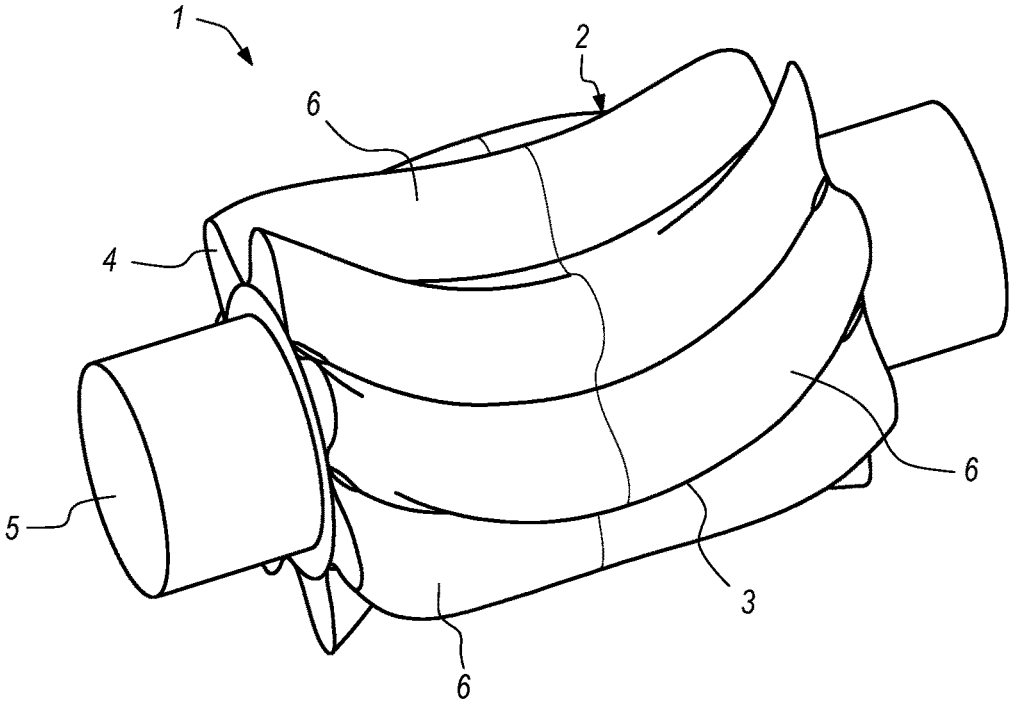
FIG. 3 shows a diagrammatic perspective view of a bi-helical toothed wheel in accordance with a first embodiment of the present invention.

FIG. 3 shows a perspective view of the toothed wheel 1 forming part of a gear 2 of the bi-helical type intended to be coupled without encapsulation to a similar gear of a hydraulic apparatus, e.g. a volumetric pump.

The toothed wheel 1 is conventionally bound to or fitted onto a support shaft 5 to form a driving or driven wheel according to the role thereof within the hydraulic apparatus.

In the embodiment described herein by way of non-limiting example, wheel 1 has front and back profiles 4 with seven teeth, but a different plurality of teeth may also be used.

According to the invention, the bi-helical development 3 of the toothed wheel 1 advantageously varies with a continuous function and a curved pattern along the axial direction of the tooth, while keeping the shape continuity of the cross section thereof, which coincides with the front and back profiles 4.

In other words, gear 2 has neither any cusp, nor any acute angle in the central zone thereof. Each corresponding tooth 6 is continuous and free from undercuts.

This particular helix development, which will be further detailed below, allows to obtain a pair of rotors in which the pitch and helix angle vary with mathematical regularity, and especially a transmission continuity with a contact ratio equal to 1 is ensured.

This basically means that: before two teeth 6 are abandoned, two other teeth 6 simultaneously begin to engage each other. The contact is continuous and reversible, and moves from the middle of the rotor outwards or vice versa, depending on the right- or left-handed rotation and on the helix arrangement.

It is also worth noting that the teeth profiles are conjugated over the whole length of the rotor, i.e. the tangents to the profiles in the contact point coincide, and the common normal passes through the instantaneous rotation center.

Figure 4:
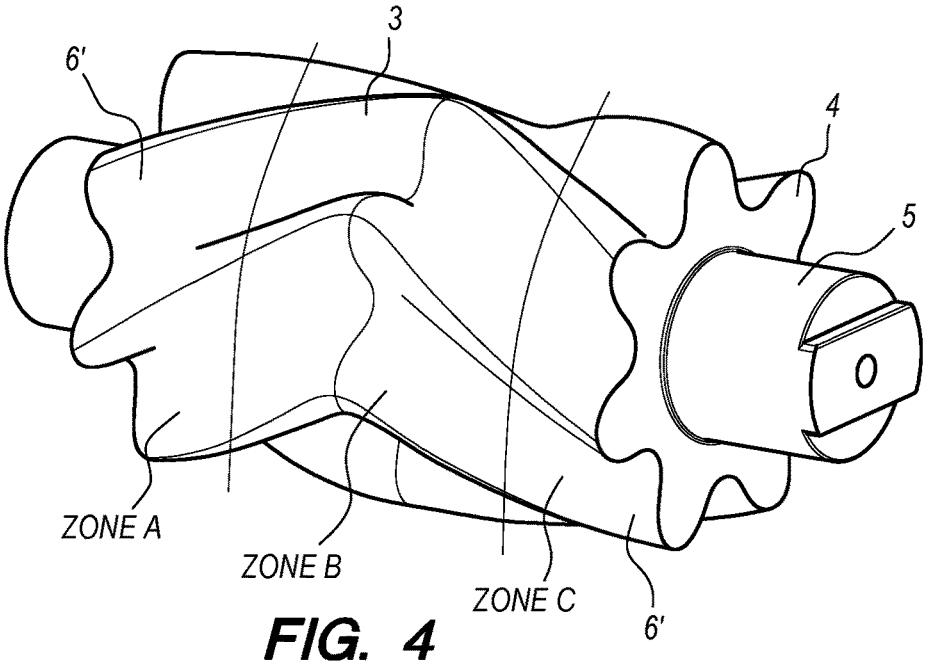
FIG. 4 shows a diagrammatic perspective view of a bi-helical toothed wheel in accordance with a second embodiment of the present invention.
Figure 5:
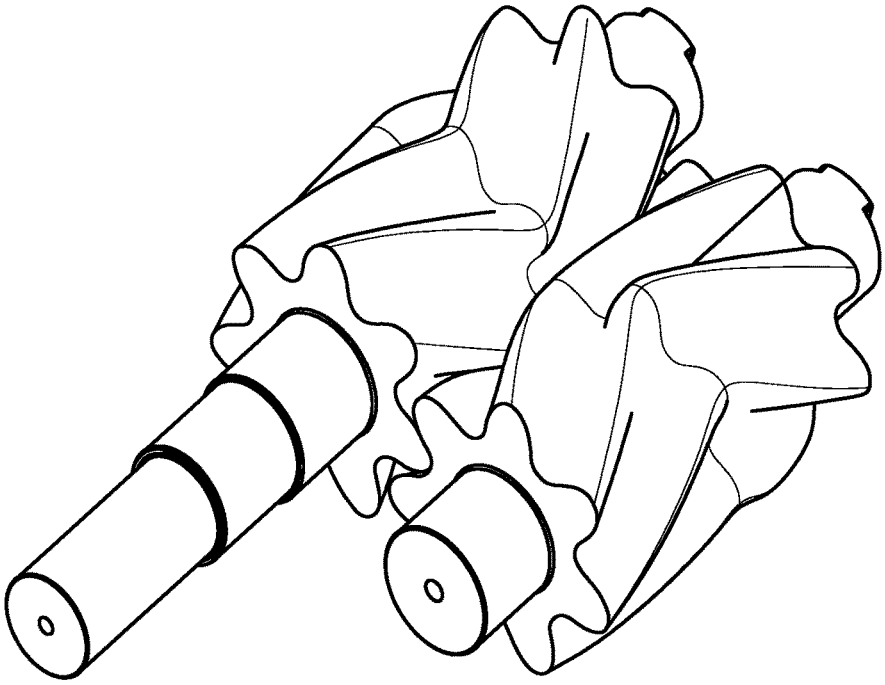
FIG. 5 shows a diagrammatic perspective view of a pair of helical toothed wheels coupled to each other in a hydraulic gear apparatus, such as a volumetric pump.

Referring now to FIG. 4, a rotor which respects the principles of the present invention but has a further improvement over the solution in FIG. 3 is shown.

Geometric assessments on the tooth thickness, mechanical evaluations on the torque transmission and on the tooth deformation and wear, as well as experimental tests led to obtain a gear which is conceptually the same as the previous one but having the following peculiarity:

zone A: constant helix angle zone B: variable helix angle zone C: constant helix angle In essence, the longitudinal development of the tooth may be split into three zones: initial, central and terminal zones, where the zones A and C correspond to the initial and terminal zones, and zone B corresponds to the central zone.

The lengths of the various rotor segments A, B and C are adjusted according to mechanical considerations and vary as the rotor band varies following a geometric rule.

Figure 6:
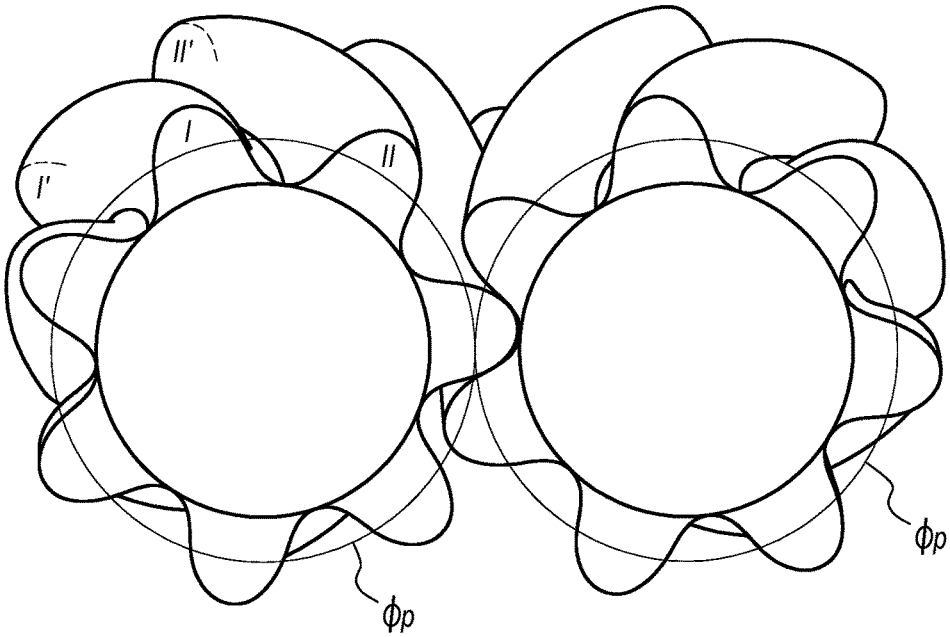
FIG. 6 shows a sectioned view perpendicular to the rotation axes of a pair of helical toothed wheels coupled to each other in a hydraulic gear apparatus, such as a volumetric pump.

As already mentioned above, the teeth 6, 6' in a helical wheel gradually mesh and unmesh. To do so in a continuous and regular manner, the situation depicted in FIG. 6 should take place, where the teeth development up to half the rotor is shown.

Figure 7:
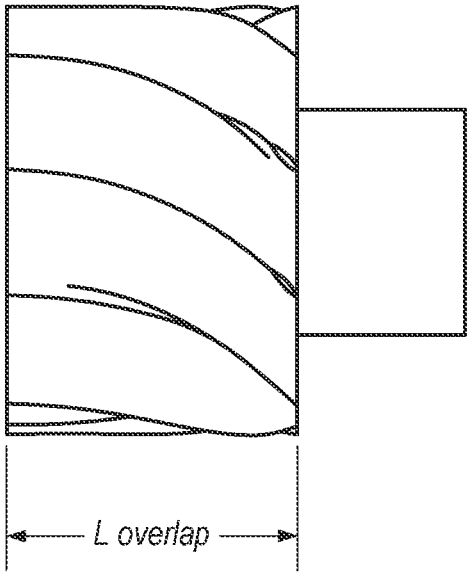
FIG. 7 shows a diagrammatic side view of a segment of a wheel according to the invention showing an overlap length.

For example, if two adjacent teeth 6 in perpendicular section to the rotation axis of the rotors are indicated by I and II, and the same teeth in perpendicular section to the rotation axis at the end of the rotor are indicated by I' and II', in order to have a continuous engagement on the pitch diameter of the rotor (φp in FIG. 6) and one tooth always engaged, I' and II' are required to be spaced apart by a distance Lf (see FIG. 7) but rotated by 360°/7, respectively (with contact ratio equal to 1); where Lf is equal to the pitch divided by the number of teeth.

This choice was adopted for the geometry development which will be described hereinbelow. However, it should be noted that rotors with the same principle but contact ratio lower or higher than 1 may be obtained.

The aforesaid condition is exactly met when, for a rotor with constant angle helix, Lf is equal to the pitch divided by the number of teeth.

In order to achieve the desired type of rotor, the teeth of the helical wheel will be oriented according to cylindrical helices for the segments A and C (as shown in FIG. 4), i.e. animated and of continuous circular motion, and at the same time of uniform straight motion having a direction perpendicular to the rotation plane, while in segment B (again as shown in FIG. 4) the helix will be formed by an animated point of continuous circular motion and various motion having a direction perpendicular to the rotation plane.

Therefore, in order to obtain the coordinates of the helix development in a three-dimensional space, a two-dimensional depiction was used.

Figure 8:
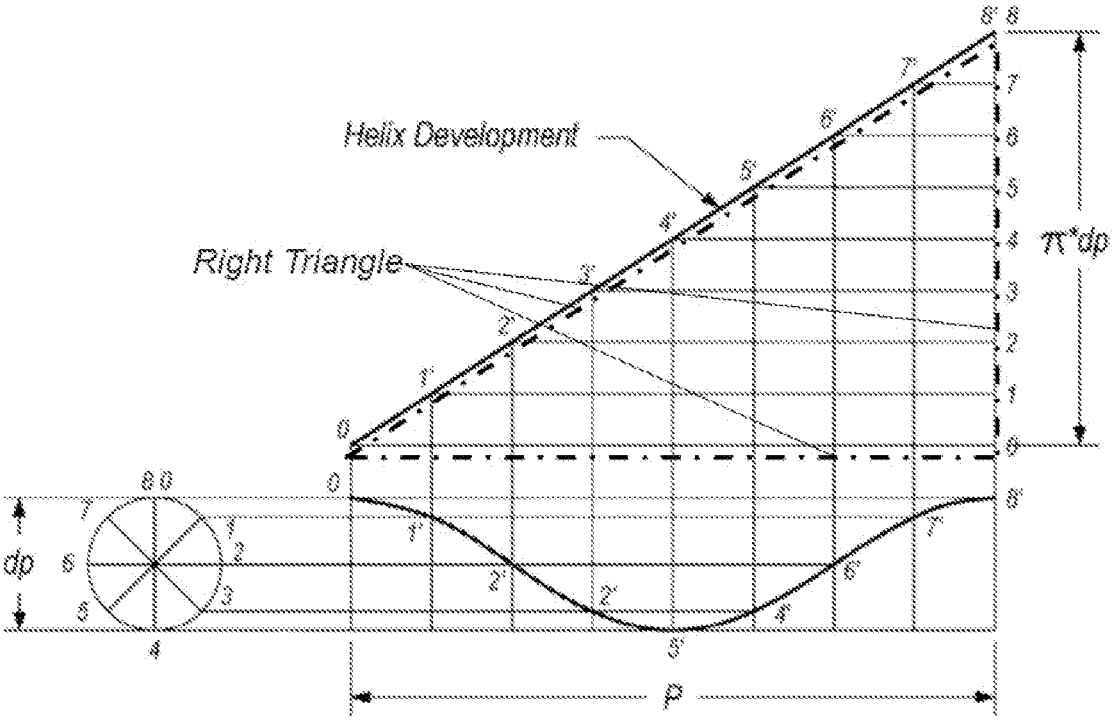
FIG. 8 shows a diagram depicting the linear development of a cylindrical helix profile.

Indeed, if from the geometric point of view, a helix is considered as a curve in the three-dimensional space, depicted by a constant angle line wound about a cylinder, this helix may also be depicted according to a straight development, as shown in FIG. 8, for example.

The development of a single helix turn is a straight line segment corresponding to the hypotenuse of the right triangle having the catheti corresponding to the pitch and length of the helix circumference. The slope is thus determined from an angle between the developing triangle hypotenuse and the cathetus corresponding to the helix circumference, thus obtaining the following relationship:

$$\tan(\alpha)=P/(\pi*dp)$$

The right triangle depicted in FIG. 8 is the helix development and is used as the basis for calculating the new bi-helical development of the gear according to the invention.

When obtaining the desired representation:

for the horizontal cathetus (to achieve a contact ratio equal to 1), the variable P is substituted by P/teeth number for the vertical cathetus (to achieve a contact ratio equal to 1), the variable π*dp is substituted by π*dp/teeth number where:

P: is the helix pitch, and dp: is the pitch diameter used for the calculation of the average helix angle.

Figure 12:
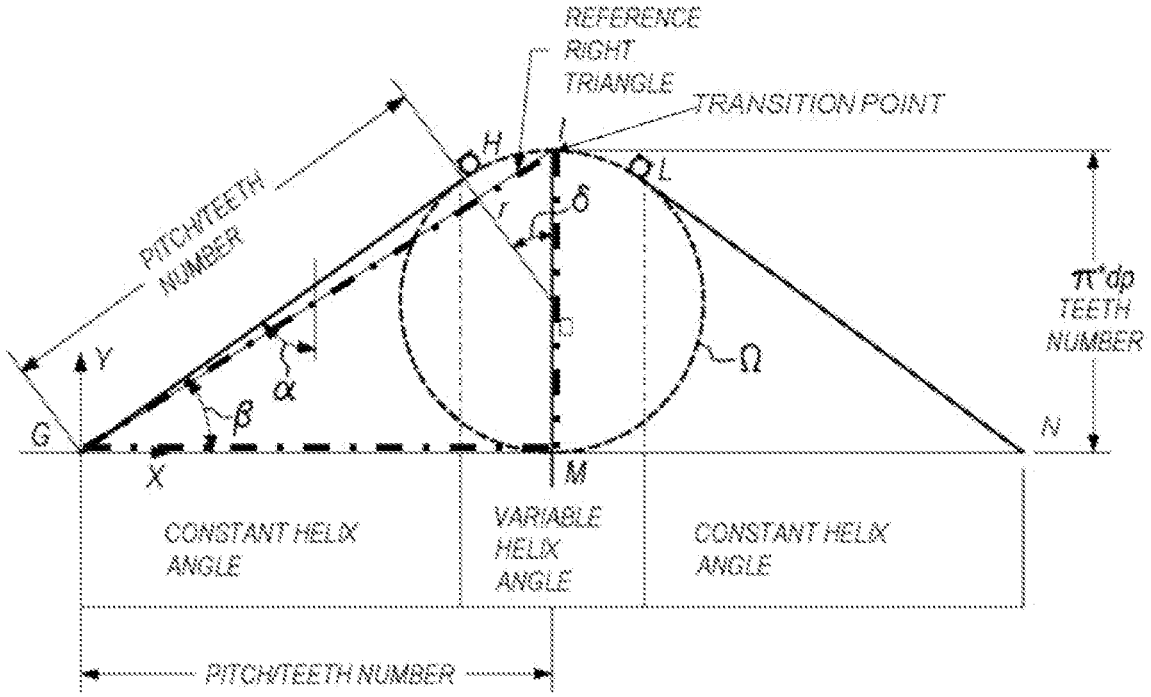

The helix angle is defined in FIG. 12 as the angle β between the hypotenuse of the right triangle representing the helix development and the cathetus pitch/teeth number, parallel to the wheel axis.

Figure 11:
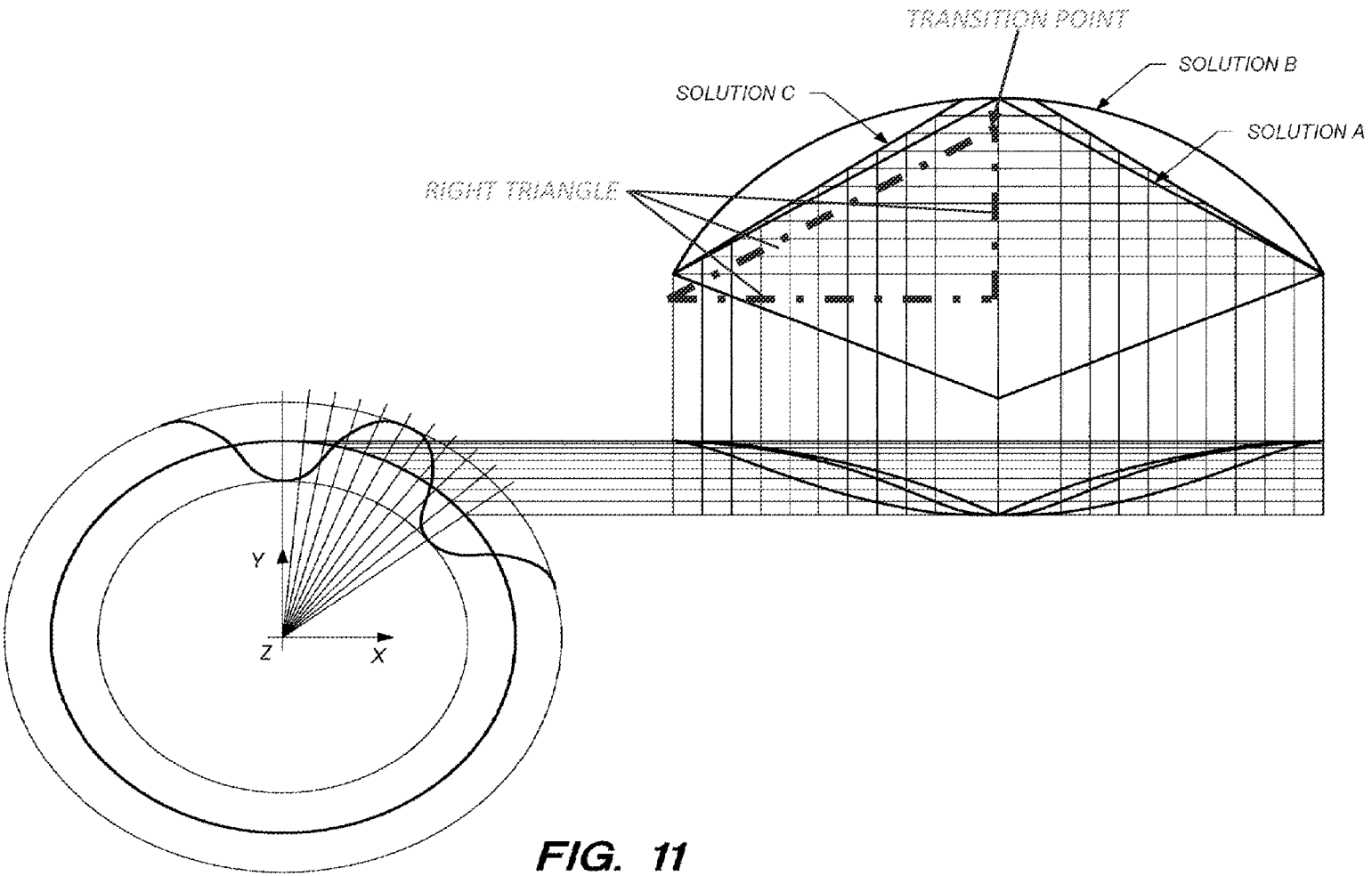

It is observed that, when reference is made to "right triangle", the same reference right triangle is depicted/referred to in each of FIGS. 8, 11, and 12.

Figure 9:
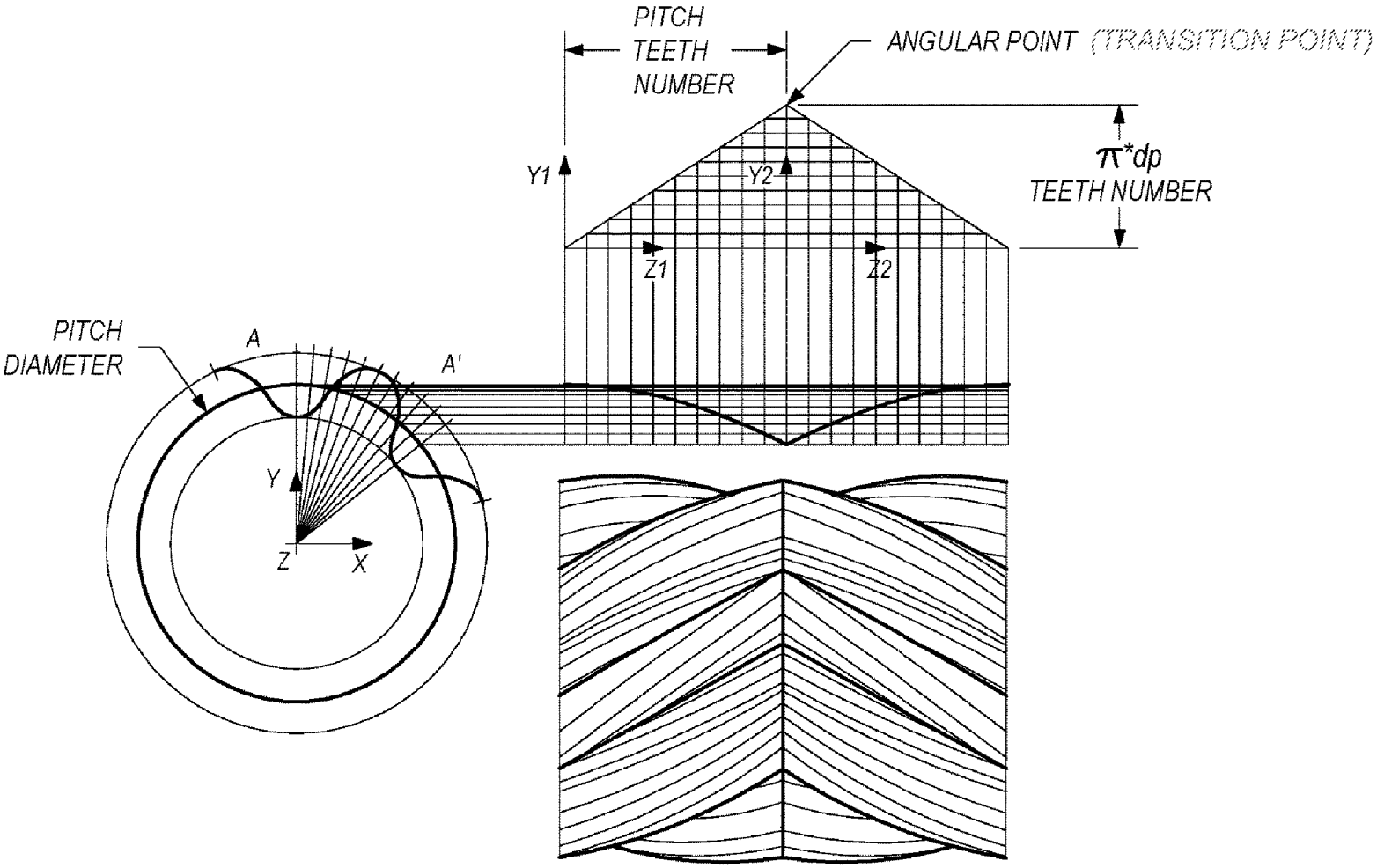
FIG. 9, FIG. 10, FIG. 11, FIG. 12, FIG. 13 show respective diagrammatic views of diagrams used to show the cylindrical helix profile of the toothed wheel according to the invention.

If the graph in FIG. 8 is reconstructed with these new variables, the situation shown in FIG. 9 is obtained, that is: an isosceles triangle constructed by tilting the right triangle in FIG. 8 with respect to the axis Y2 and where the angular point of a traditional herringbone gear is indicated by its vertex, as it corresponded to the central point of the rotor.

If a profile A moving perpendicularly along an axis Z is considered, coinciding with the rotation axis of the rotor, by rotating about such an axis Z and translating with uniform straight motion along Z, and the following references A and A' are used to indicate:

A, the section in the initial position A

A', the section in the final position Z, then the infinite sections between A and A' have the same profile. In other terms, when sectioning the rotor perpendicularly to the rotation axis (or axis Z) in any spatial position, the profile does not change, as already disclosed above with reference to the preservation of the shape continuity of the cross section of the profile.

In order to simplify the calculation method, the attention can be focused only on one half of the rotor and a Cartesian reference system X1-Y1 can be placed, for example, for developing a turn which will correspond to a straight line segment corresponding to the hypotenuse of the right triangle having the pitch/teeth number and the helix circumference length/teeth number as the catheti.

Thereby, a Cartesian equation is obtained in an explicit form of the straight line to describe the development of the helix turn.

If the abscissa (F) and the ordinate (A) of a right triangle which represents half of the helical development of the rotor tooth are defined as two dependent variables:

(F) the variable indicating the axial position of the helix turn, (A) the variable indicating the position of the helix turn on the pitch diameter $$y=mx+q \text{ with } q=0 \text{ and } A=tg\beta*F,$$

then a series of points Fi and Ai may be obtained over the whole helix development in the direction of axis Z.

Figure 10:
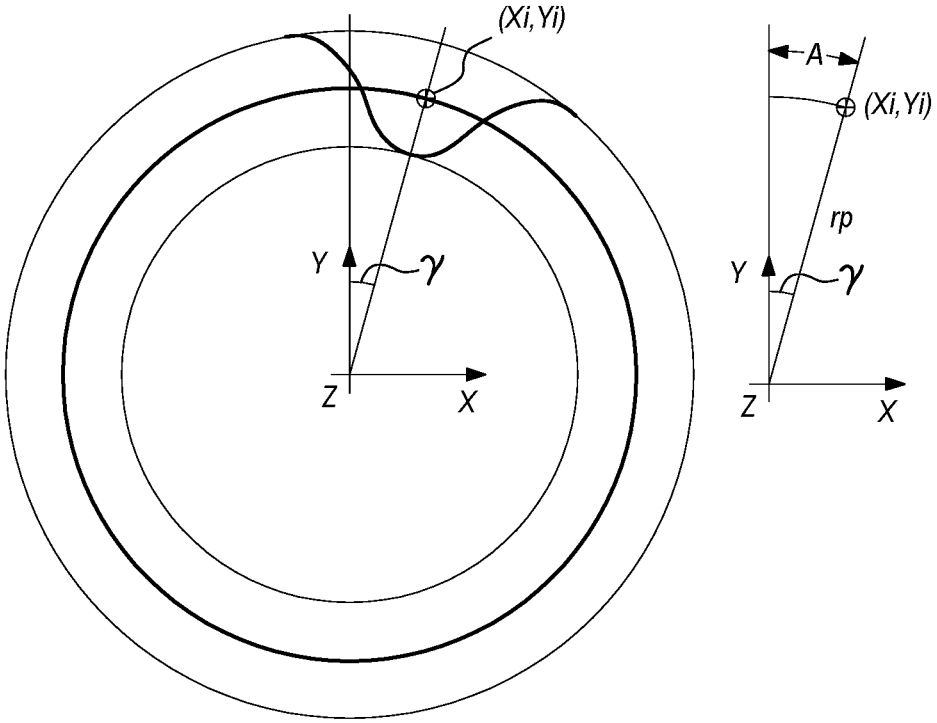

In order to obtain the two missing coordinates Xi and Yi, the following may be done. Referring to FIG. 10, the length of the arc of circle at a given axial height Fi obtained according to the previous relationship A=tgβ*F can be considered as known.

Knowing that A=γ*rp, it is possible to obtain γ=A/rp and therefore $$Xi=rp*\sin(\gamma)$$

$$Yi=rp*\cos(\gamma)$$

Once the series of coordinates (Xi; Yi; Zi) required to fully describe the helix development in the three-dimensional space has been completed, the geometry of the rotor may be drawn by means of a suitable 3D software.

It is sufficient to provide a computer having a 3D processing software with the profile coordinates (X; Y) and with those of two helix turns (Xi, Yi, Zi) bound at the ends of the profile.

Thereby, the inter-tooth space may also be drawn. However, different methods may be used to construct the geometry using a 3D software, the previous example being just one of several possibilities.

However, returning to the example in FIG. 9, it is worth understanding the process used to suppress the acute angles from the angular central point located in the zone B of the rotor, i.e. in the point where the cylindrical helix profile orientation is changed.

The angular point in the center of FIG. 9 mathematically has two derivatives, a right-handed derivative and a left-handed derivative depending on which sloped part is taken into account.

By imposing a single derivative "0" in that point, a function is thus obtained, which will describe the helix development in that point. This means that in that point there will be a tangent to the horizontal graph with negative second derivative, therefore the starting function has a relative maximum here.

For example, by applying the equation of a circumference as a function, a connection point having a zero derivative may be obtained.

In other words, by deriving the function which describes the helix development, the complementary angle of the helix angle (α) may be obtained, which is variable point-by-point along the rotor axis at a determined point on the pitch diameter.

From the mathematical analysis, indeed, the derivative of a function f in a point X0 is known to be the value of the angular coefficient of the straight line tangent to the curve in that point, i.e. the trigonometric tangent of the angle formed by the tangent in a point of the curve of equation y=f(x) and the axis of abscissas.

It is worth noting that, if the helix development is considered over a complete turn along the axial direction (which corresponds to the helix pitch), the function describing the behavior thereof is the same in the case with constant helix angle.

On the other hand, in the case of variable helix angle in order to obtain a contact ratio equal to 1 and suppress the angular point in the middle of the rotor, the resulting geometric construction leads to the formulation of a single function depending on the length of the rotor band obtained from pitch/teeth number and from the ratio (dp*π)/teeth number.

In order to define such a geometric function, three steps are required, starting for example from establishing some design parameters, such as:

1)

Pump capacity

Rotor diameters

Minimum helix angle

Minimum tooth thickness

A geometric construction is then obtained, which represents the desired shape of the helix development close to the cylindrical helix orientation change.

2)

The depiction of the reference right triangle is first carried out, as shown in FIG. 11 for example, then the constant angle helix development is constructed, this allowing to obtain two catheti which represent the basis for the construction the new helix development and will be, respectively:

$$F=\text{pitch/teeth number}$$

$$A=\pi*dp/\text{teeth number}$$

As shown in FIG. 12, the angular central point is fully suppressed by drawing a circle of diameter **2*r*** centered with respect to cathetus A.

Starting from G, a segment having a length F tangent to the circle Ω (perpendicular to the circle radius r) is drawn. A point H is identified, which represents the end of the first rotor segment with constant helix angle.

The arc of circle passing through H-I-L identifies the central zone of the rotor with variable helix angle, zone B.

Symmetrically, the length segment L-N completes the final segment of the rotor with constant helix angle.

3)

At this point, the equations describing the helix development need to be determined. The variables depicted in FIG. 11 will be used to write the formulas required to obtain the coordinates (Xi; Yi; Zi) of the turns on which the front section profile will move by describing the geometry of the inter-tooth space.

Figure 13:
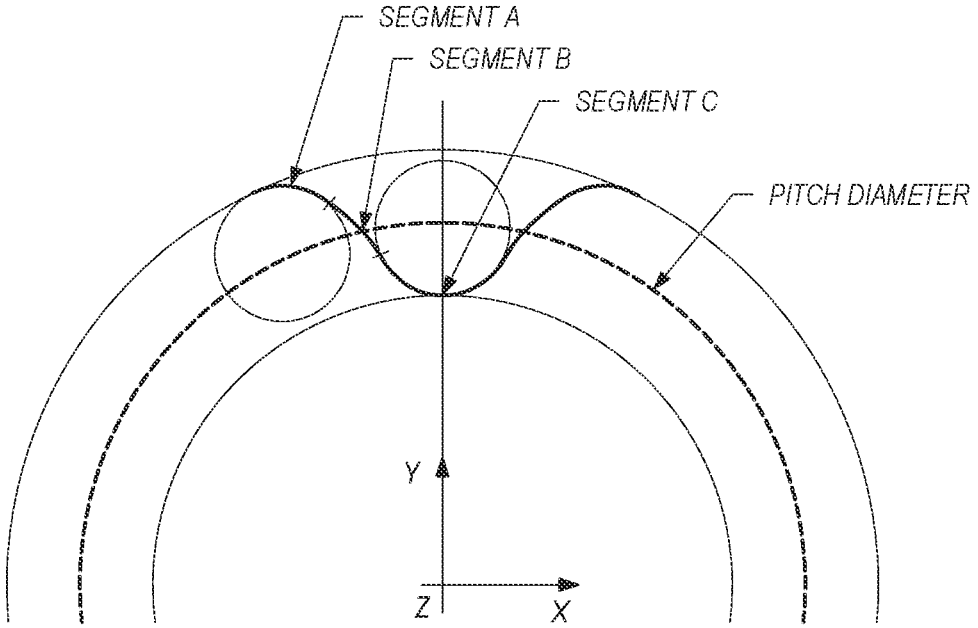

With reference to FIG. 13, the gears used appreciably have a profile achieved by means of arcs of circle obtained from cycloidal profiles in the tooth bottom zones (segment C) and on the crest (segment A), whereas in order to generate the zone close to the pitch diameter, a polar equation of the circle involute (segment B) was used.

Figure 14:
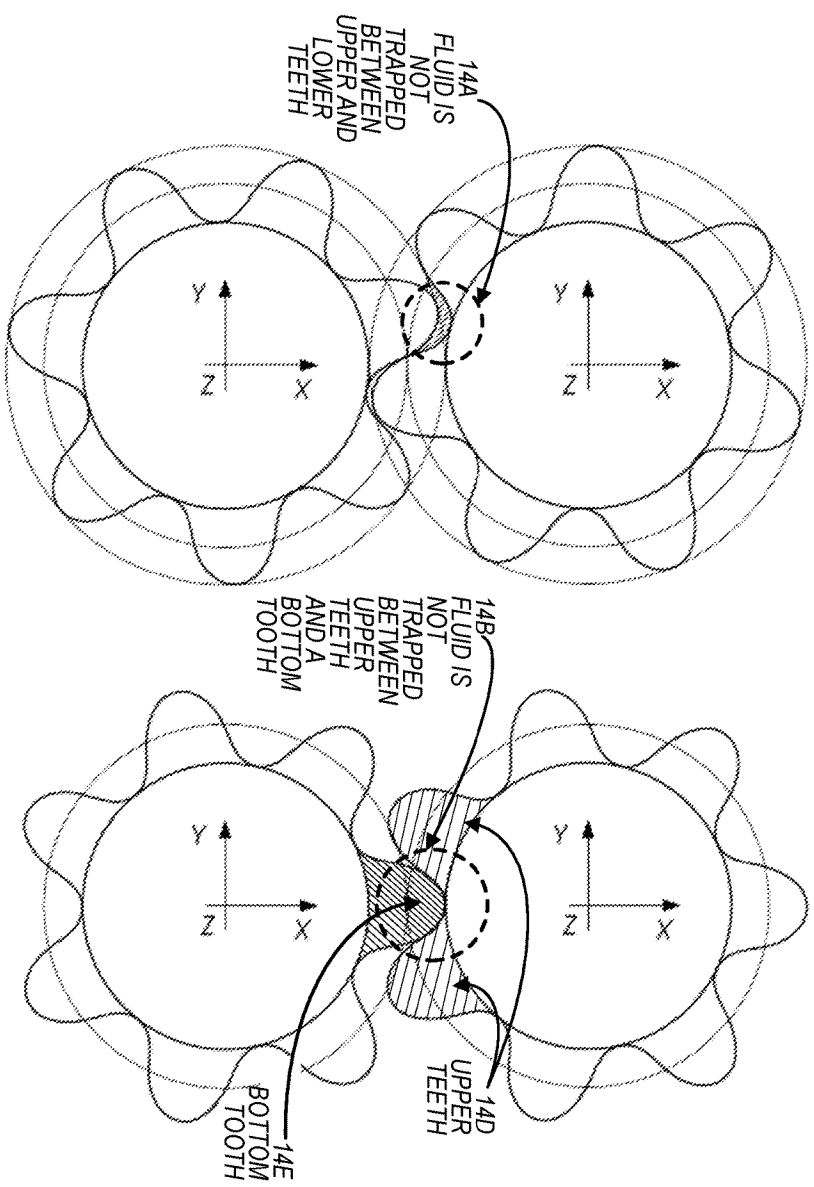
FIG. 14 shows a diagrammatic front view of a pair of engaging toothed wheels without encapsulation according to the invention.

FIG. 14 diagrammatically shows the drawing of the conjugated profiles in the plane, which may occur in various different manners, but in this example by means of the envelope method.

The contact is seamless over the whole development of the tooth in order to avoid the fluid from being encapsulated by the gears during the relative motion thereof.

During meshing, a contact point of the wheels moves continuously over the whole profile of the teeth in such a way that any closed area of fluid encapsulation is avoided. In some embodiments, the teeth are shaped so as to avoid the fluid from being encapsulated (trapped) between tooth crests and tooth bottoms during a relative motion of the wheels. The left diagram and the right diagram of FIG. 14 show a top wheel and a bottom wheel at two different states 14A and 14B during two separate times, with the state 14B occurring after state 14A during the relative motion of the wheels. At state 14A, the contact is at approximately the midpoints of an upper tooth of the top wheel and a lower tooth of the bottom wheel. As the contact point moves continuously over the whole profile of the teeth, no fluid is encapsulated between the upper teeth of the top wheel and the lower teeth of the bottom wheel. At state 14B, when a tooth crest of a bottom tooth 14E engagingly contacts a tooth bottom of an upper tooth (e.g., a valley between the upper teeth 14D), no fluid is encapsulated between the upper teeth and the bottom tooth.

From the above description it is apparent that the profile of the toothed wheel according to the invention also allows to fully solve the problems related to the machining thereof by means of machine tools.

Indeed, the toothed wheel of the present invention may be achieved by means of numerically controlled machines powered by a specific software derived from the 3D construction of the above-described bi-helical development model of the gear.

More particularly, the toothed wheel according to the invention may be obtained by means of an automatic numerically controlled machine powered by a specific software derived from a 3D construction of the bi-helical development model of the wheel tooth, as described with reference to the preceding formulas, thus obtaining a helix development which is curved in a continuous manner along the longitudinal direction of the tooth, while also keeping the shape continuity of the cross section thereof.

Advantageously, the aforesaid machine is a numerically controlled working station with at least four axes.

Figure 15:
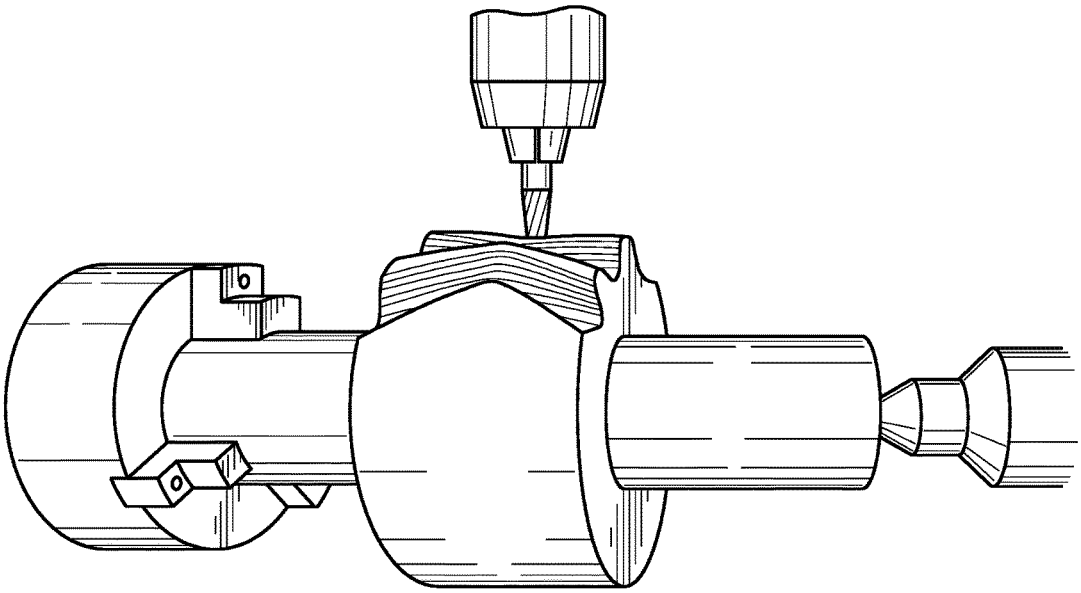
FIG. 15 shows a perspective view of a step of machining the toothed wheel according to the invention obtained on a machine tool.

FIG. 15 is an exemplary, diagrammatic depiction of the toothed wheel according to the invention.

The detailed operating steps may be as follows:

Step 1:

Writing the non-encapsulating profile equations and the pitch and helix angle equations.

Step 2:

Creating the solid model by using a 3D software.

Step 3:

Transferring the solid model to CAD-CAM

Step 4:

Roughing the inter-tooth space using the numerically controlled working station, such as a five-axis machine, for example.

Step 5:

Thermally treating by means of surface hardening at 58-60 HRC. This step can be optional.

Step 6:

Grinding shanks and shims

Step 7:

Finishing the inter-tooth space on the working station

The invention solves the technical problem and achieves several advantages, first of all the possibility of manufacturing contra-rotating gears with partially or totally variable helix angle, with non-encapsulating profile and a shape so as to suppress the cusp in the middle of the rotors.

Moreover, the accurate and continuous opposite slope of the teeth does not generate any axial force which can cause the displacement of the wheel, the latter being able to be incorporated in gears which are free from axial compensation.

In a few words, the invention allows to manufacture contra-rotating rotors, with non-encapsulating profile and with a helix shape capable of suppressing the angular point in the middle of the rotors themselves, and thus suppressing all the problems related to their machining by means of machine tools.

The invention further allows to manufacture gears for contra-rotating hydraulic apparatuses with partially or totally variable helix angle.

What is claimed is:

1. A hydraulic gear apparatus, comprising:

a pair of identical meshing bi-helical toothed wheels being bound to support shafts and each toothed wheel of said pair of identical meshing bi-helical toothed wheels including:

a plurality of teeth;

a crest of a tooth of the plurality of teeth of one of said identical meshing bi-helical toothed wheels having engaged contact to a tooth bottom disposed between respective tooth crests of two adjacent teeth of the plurality of teeth of the other of said identical meshing bi-helical toothed wheels so that fluid is prevented from being encapsulated between a profile of the tooth crest of the one of said identical meshing bi-helical toothed wheels and a profile of the tooth bottom of the other of said identical meshing bi-helical toothed wheels during rotation of said pair of identical meshing bi-helical toothed wheels;

wherein each tooth of the plurality of teeth:

has a variable helix angle with continuous function in a longitudinal direction parallel with a rotation axis of one of the support shafts that corresponds to a respective toothed wheel of said pair of identical meshing bi-helical toothed wheels:

begins with a right-handed helix at an end of the respective toothed wheel and ends with at left-handed helix at an opposite end of the respective toothed wheel of said pair of identical meshing bi-helical toothed wheels;

includes a transition point between the right-handed helix and the left-handed helix in which the variable helix angle is 0° and right and left derivatives of a helix angle function are finite and equal at the transition point.

2. The hydraulic gear apparatus according to claim 1, wherein each tooth of the plurality of teeth includes an initial zone and a terminal zone, wherein said initial and said terminal zones each have a constant helix angle.

3. The hydraulic gear apparatus according to claim 2, wherein a respective tooth of the plurality of teeth is defined by a helix, a two-dimensional development of said helix being a straight line segment corresponding to the hypotenuse of a right triangle having the catheti corresponding to the pitch of the respective tooth and to the circumference of the one of said pair of identical meshing bi-helical toothed wheels; the slope of said straight line segment being determined from an angle alpha (α) between the developing triangle hypotenuse and the cathetus corresponding to the circumference of the one of said pair of identical meshing bi-helical toothed wheels according to the following relationship:

$$\tan(\alpha)=P/(\pi*dp)$$

where:

P: is the helix pitch, and dp: is the pitch diameter of helix circumference.

4. The hydraulic gear apparatus according to claim 3, wherein said right triangle is used with the following correlations of substitution:

for the horizontal cathetus, with a contact ratio equal to 1, the variable P is substituted by the relationship pitch divided by teeth number (P/teeth number)

for the vertical cathetus, with contact ratio equal to 1, the variable Greek-PI multiplied by the pitch diameter (π*dp) is substituted by the relationship Greek-PI multiplied by the pitch diameter divided by the teeth number (π*dp/teeth number) where:

P: is the helix pitch, and dp: is the pitch diameter of helix circumference.

5. The hydraulic gear apparatus according to claim 1, wherein said pair of identical meshing bi-helical toothed wheels has a contact ratio between 0.6 and 1.4.

6. The hydraulic gear apparatus according to claim 1, wherein said hydraulic gear apparatus is a volumetric pump.

7. The hydraulic gear apparatus according to claim 1, wherein said hydraulic gear apparatus is a hydraulic gear motor.

8. The hydraulic gear apparatus according to claim 1, wherein each tooth of the plurality of teeth comprises three zones including an initial zone, a central zone following the initial zone, and a terminal zone following the central zone.

9. The hydraulic gear apparatus according to claim 8, wherein each of the initial and the terminal zones have a symmetrical helix angle.

10. The hydraulic gear apparatus according to claim 8, wherein each of the initial and the terminal zones have a respective constant helix angle with a right-hand orientation and a left-hand orientation.

11. The hydraulic gear apparatus according to claim 8, wherein the central zone has the variable helix angle.

* * * * *